United States Patent [19]

Nelson et al.

[11] 3,958,484

[45] May 25, 1976

[54] SEALING MEANS FOR WIND INSTRUMENTS

[75] Inventors: Robert E. Nelson; Robert D. Gilbert, both of Los Angeles, Calif.

[73] Assignee: Roberts' Products, Inc., Los Angeles, Calif.

[22] Filed: May 29, 1975

[21] Appl. No.: 581,852

[52] U.S. Cl. ..... 84/380 R; 84/385 P

[51] Int. Cl.[2] ..... G10D 7/00

[58] Field of Search ..... 84/380, 385

[56] References Cited

UNITED STATES PATENTS

| | | | |
|---|---|---|---|
| 2,534,660 | 12/1950 | Collis | 84/385 |
| 2,540,760 | 2/1951 | Schoemann | 84/385 X |
| 2,957,381 | 10/1960 | Hillyard | 84/385 X |
| 3,608,416 | 9/1971 | Nagao | 84/380 |
| 3,767,506 | 10/1973 | Kawakami | 84/380 X |

*Primary Examiner*—John F. Gonzales

*Attorney, Agent, or Firm*—Poms, Smith, Lande & Glenny

[57] ABSTRACT

Improvement in sealing means for wind instruments wherein pads are mounted on the cups of keys which are actuated to open one or more tone holes on such instruments which holes are normally closed by the pads. The improvement resides in the pads being comprised of a first layer of a relatively soft, closed-cell, cross-linked polyethylene foam material which is adapted to enter the tone hole of such instruments and seal it off from the atmosphere thus preventing air leaks through such holes and a second layer, bonded to the first layer, of a greater rigidity than the first layer, of a closed-cell polyethylene foam material which is adapted to be secured to the key cup thus forming a pad having a long life and one which is unaffected by moisture.

15 Claims, 4 Drawing Figures

SEALING MEANS FOR WIND INSTRUMENTS

BACKGROUND OF THE INVENTION

1. Field of the Invention

The invention relates to musical wind instruments; and, more particularly, to an improved pad for sealing off tone holes in such instruments.

2. Description of the Prior Art

Wind instruments include a plurality of tone holes which produce different tones when playing the instrument. By selectively opening one or more of these holes with respect to the others, which are normally closed, different tones may be produced.

In closing off such holes, the tone hole must be sealed in a manner whereby air leaks or the like are not present. Such air leaks are undesirable since this would of course vary the desired sound.

In the past, conventional pads have been used to seal off such tone holes. These pads are generally made of cork, plastic, or so-called "skin" pads. "Skin" pads are made of cardboard and felt or the like stamped to size by a machine, after which sheep or fish bladder skin or the like is drawn around the cardboard and felt and maually glued at the underside. These pads are then glued or otherwise secured to the keys of the instrument. When all of the foregoing pads are torn, scuffed or punctured, moisture may enter the pad, as for example, the cork or felt portions, and cause the pad to enlarge. This produces air leaks and the pad must be replaced.

Further, in order to properly seal the components of such pads together during manufacture, they must be clamped down for a relatively long period of time, such as overnight. There is thus a need for pads for wind instruments which may be quickly and easily manufactured and are unaffected by moisture so as to provide long, trouble-free life and no air leaks through the tone holes.

SUMMARY OF THE INVENTION

It is an object of this invention to provide improved sealing means for keys of wind instruments.

It is a further object of this invention to provide an improved pad for the keys of wind instruments for sealing off the tone holes of such instruments thus preventing air leaks therethrough.

It is still another object of this invention to provide improved pads for wind instruments which are easily manufactured, are noiseless during use, unaffected by moisture and have a relatively long life.

These and other objects are preferably accomplished by providing a pad for closing off the tone hole of a wind instrument in a leakproof, noiseless manner. The pad is comprised of a first layer of a relatively soft, closed-cell, cross-linked polyethylene foam material which is adapted to enter the tone hole of such instruments and seal it off from the atmosphere, thus preventing air leaks through such holes and a second layer, bonded to the first layer, of a greater rigidity than the first layer, of a closed-cell polyethylene foam material which is adapted to be secured to the key cups thus forming a pad having a long life and one which is unaffected by moisture.

DESCRIPTION OF THE PREFERRED EMBODIMENT

Figure 1:
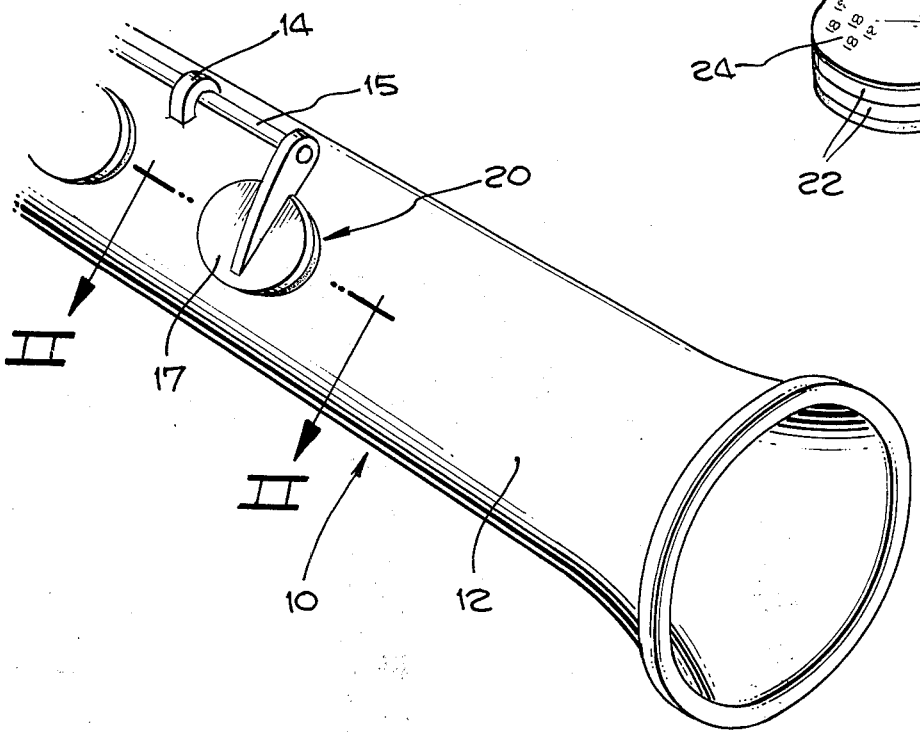
FIG. 1 is a vertical view of a portion of a conventional musical wind instrument having the improved sealing means of our invention mounted thereon.

Referring now to the drawing, a conventional wind instrument, such as a clarinet 10, is shown having sealing means in the form of pads 20 in accordance with the teachings of our invention mounted thereon. Clarinet 10 thus includes main body portion 12. As is well known, a plurality of different sized tone holes 13 (FIG. 2) extend along body portion 12. A pivot post 14 is associated with each tone hole 13 and a key comprised of a lever 15 extends through each post 14 having a flattened portion (not shown) at one end for engagement by the fingers of the user. The opposite end of each lever 15 terminates in a key cup 17. These levers 15 are normally biased in a manner (not shown) normally sealing off each tone hole 13.

Figure 2:
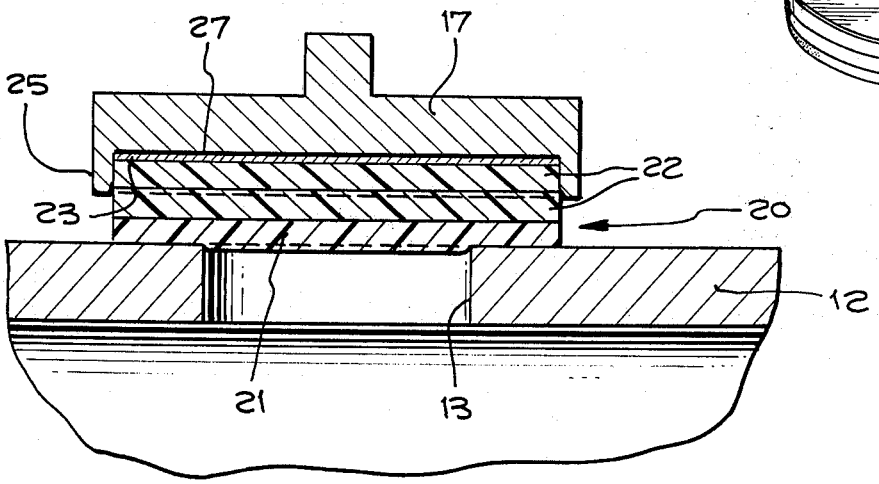
FIG. 2 is a view taken along lines II—II of FIG. 1.

Thus as particularly contemplated in the present invention, sealing means are associated with each key cup 17. The sealing means are in the form of pads 20 which are removably secured to each key cup 17 in any suitable manner, such as by glueing, (in the case of pads 20 of FIG. 3), screws, clips or the like, (in the case of pads 26 of FIG. 4) so as to be replaceable, when desired. That is, certain key cups require pads without apertures (e.g., pads 20) and other key cups require pads with apertures (e.g. pads 26 of FIG. 4), the latter key cups having stubs or the like for receiving the aperture in the pad therein. Levers 15 are normally biased in a manner whereby a portion of the pads enters the tone holes and seals off the tone holes until the keys are pressed to raise the key cups 17. Thus, a portion of the pads 20, as shown in FIG. 2, enters the tone holes 13 to seal them off from the air blowing through main body portion 12 when the clarinet 10 is played.

Figure 3:
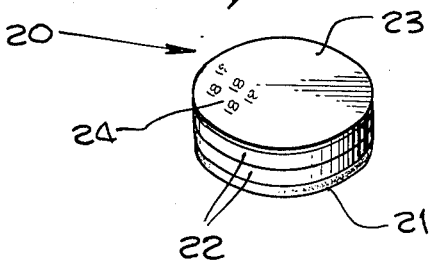
FIG. 3 is a perspective view of the sealing means alone of FIGS. 1 and 2.
Figure 4:
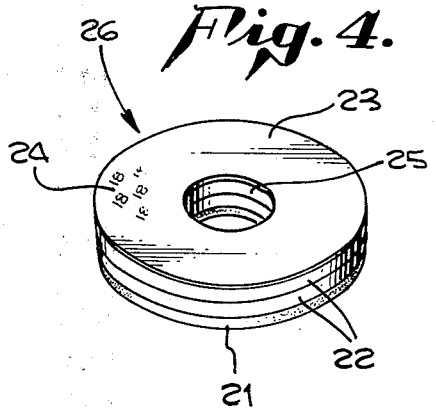
FIG. 4 is a perspective view of an alternate form of the sealing means of our invention.

Thus, in the exemplary embodiment of the invention, the sealing means includes a first layer 21 (FIG. 2) of a relatively soft cross-linked closed-cell polyethylene foam material which is bonded to a second layer 22 of a semi-rigid closed-cell polyethylene foam material, as by heat fusion, glueing, laminating or the like. A top layer 23, (FIGS. 3 and 4) may be secured to layer 22, as by glueing, and may be comprised of a polyethylene film which, as shown in FIG. 3, may have suitable indicia 24 thereon indicating the tone hole 13 for which pad 20 is to be used. Obviously, any suitable material such as imprinted paper or cardboard, may be used for layer 23.

Although layers 21 and 22 have been described as two layers, when laminated or otherwise fused together they form a unitary structure having a relatively soft upper portion (layer 22) and a relatively rigid lower portion (layer 21). Further, although only a single layer 22 of the semi-rigid polyethylene foam material has been disclosed, this material may be made up of more than one layer of the same material, as, for example, when the material for layer 22 is only available in one particular thickness, as for example, sheets of 40 mil in thickness. Thus, one or more layers, such as two layers of 40 mil thickness each may be bonded together to form a single layer 22 as shown in FIGS. 2 and 3. Thus, two layers, each approximately 40 mils thick, may be used to form a single layer 22 of approximately 40 mils thick. Layer 21, on the other hand, may be a single layer approximately 40 mils thick, resulting in an overall thickness of layers 21 and 22 of approximately 120 mils. Layer 23 may be any suitable thickness, as for example, 3 mils thick.

The overall diameter of pads 20 and 26 of course varies depending on the size of the tone holes 13. For example, 16 sizes may be provided for the holes 13 of clarinet 10 ranging from 0.436 inches in diameter to 0.736 inches in diameter. The layer 21 is preferably of a diameter slightly larger than the diameter of tone hole 13 so as to have a portion thereof enter the hole 13 as shown in FIG. 2 and seal it off. In manufacturing pads 20 and 26, sheets of layers 21–23 may be formed and adhered together as discussed hereinabove, then the different sized pads 20 stamped by machine from the sheets. The indicia 24 may be imprinted in sheet or layer 23 before stamping.

Although any suitable closed-cell crosslinked polyethylene foam may be used for layer 21, the high expansion polyethylene foam material sold under the trademark Volara by Voltek, Inc. of Lawrence, Massachusetts is preferred. This material is offered by Voltek Inc. in two types, Type A and Type E, either type being suitable. Both types are non-toxic, odorless, and are very low in moisture absorption and water vapor transmission. We prefer to use the Type A material but the Type E may also be used, if desired. The specifications for the Types A and E materials are as follows:

TYPE A

| Specification | Units | | Density, Pounds per Cubic Foot 2 | 4 | 6 |
|---|---|---|---|---|---|
| Tensile Strength | | | | | |
| ASTM D-412 | psi, | M | 40 | 95 | 130 |
| Die C | average* | C | 30 | 70 | 95 |
| Elongation | | | | | |
| ASTM D-412 | % | M | 210 | 315 | 285 |
| Die C | | C | 150 | 235 | 250 |
| Tear Resistance | | | | | |
| ASTM D-624 | lbs./in. | M | 10 | 23 | 33 |
| Die B | | C | 6 | 16 | 25 |
| Compression-Deflection | | 25% | 5 | 9 | 12 |
| ASTM D-1056 | psi. | 50% | 12 | 19 | 24 |
| | | 75% | 36 | 57 | 74 |
| Permanent Set | | | | | |
| ASTM D 1056 | | | | | |
| 22 hr. comp. | % of | | | | |
| at 50% defl.; | original | | 6** | 15 | 10 |
| 24 hr. recovery | thickness | | | | |
| Shore Hardness | | | | | |
| ASTM D-2240 | | | | | |
| AA Scale | | 6.5 | 16 | | 21 |
| OO Scale | | 50 | 64 | | 70 |
| Thermal Stability | % shrinkage | | | | |
| 3 hrs, no load, | in linear at 180°F | 0.8–1.5 | 0.7–1.4 | | 0.2–0.9 |
| 12"×12" sample | dimensions at 215° F | 1.6–4.0 | 1.4–2.1 | | 0.7–1.9 |
| Low Temperature | | | | | |
| Brittle Point | | | | | |
| 180° flex, | °F | −110, all densities | | | |
| ½" mandrel | | | | | |
| Thermal Conductivity | BTU-in./hr.-ft.$^2$ −°F | 0.28 | 0.30 | | 0.32 |
| Water Absorption | lbs./sq.ft. of | | | | |
| ASTM D-1667 | cut surface, | 0.04 | 0.04 | | 0.04 |
| Method | Maximum | | | | |
| Dielectric Strength | Volts/mil | 120 | 140 | | 175 |
| Dielectric Loss | tan delta(1 kc) | $1\times10^{-4}$ | $3\times10^{-4}$ | | $5\times10^{-4}$ |

NOTE:
M=Machine Direction
C=Transverse Direction
*Unless otherwise stated, all values represent averages of test data. Variation of test data is ± 10% from average.
**This value based on 25% deflection instead of 50%.

TYPE E

| Specification | Units | | Density, Pounds per Cubic Foot 2 | 4 | 6 |
|---|---|---|---|---|---|
| Tensile Strength | | | | | |
| ASTM D-412 | psi, | M | 70 | 170 | 200 |
| Die C | minimum | C | 45 | 110 | 150 |
| Elongation | | | | | |
| ASTM D-412 | % | M | 300 | 360 | 500 |
| Die C | minimum | C | 200 | 300 | 400 |
| Tear Resistance | | | | | |
| ASTM D-624 | lbs./in., | M | 8 | 20 | 30 |
| Die B | minimum | C | 6 | 15 | 25 |
| Load Deflection | psi, | 25% | 4 | 6 | 10 |
| ASTM D-1056 | minimum | 50% | 10 | 15 | 20 |
| | | 75% | 30 | 40 | 60 |
| Permanent Set | | | | | |

-continued

| Specification | Units | TYPE E Density, Pounds per Cubic Foot 2 | 4 | 6 |
|---|---|---|---|---|
| ASTM D-1056 22 hr. comp. at 50% defl.; 24 hr. recovery | % of original thickness maximum | 6* | 15 | 10 |
| Shore Hardness ASTM D-2240 AA Scale | | 6 – 7 | 13–14 | 19–20 |
| OO Scale | | 45 – 47 | 56–58 | 63–65 |
| Thermal Stability 3 hrs. at 180° F | % change in linear Dim., maximum | −5 | −3 | −2 |
| Low Temperature Brittle Point 180°Flex, ½" mandrel | °F | −110, all densities | | |
| Water Absorption ASTM D-1667 Method | lbs./sq.ft. of cut surface maximum | 0.04 | 0.04 | 0.04 |

NOTE:
M=Machine Direction
C=Transverse Direction
*This value based on 25% deflection instead of 50%.

Both types are offered in different densities. We have found that four pounds per cubic foot of the Type A Volara material gives us the desired tensile strength, elongation, tear resistance, permanent set and compression-deflection.

Although any suitable closed-cell low density polyethylene foam material may be used for layer 22, the semi-rigid polyethylene low expansion foam material sold under the trademark VOLITE by Voltek, Inc. of Lawrence, Massachusetts is preferred. This material has high water resistance, good chemical stability, is non-toxic and odorless and is offered by Voltek, Inc. in densities ranging from 30 to 40 pounds per cubic foot. This range of densities give us the desired tensile and tear strength and elongation. The specifications for Type S Volite material, Type S being typical of the types of Volite material offered by Voltek, Inc., are as follows:

| Property | Units | | VOLITE Type S |
|---|---|---|---|
| Density | pcf | | 30–40 |
| Tensile Strength | psi | MD | 1400 |
| | | CD | 1200 |
| Ultimate Elongation | % | MD | 80 |
| | | CD | 77 |
| Tear Strength | gr/mil | MD | 274 |
| | | CD | 379 |

MD: Machine Direction
CD: Cross Direction

Any suitable material may be used for layer 23. We have found that the polyethylene material sold under the trademark KROMKOTE by Voltek Inc. of Lawrence, Massachusetts is preferred.

The pads 20 and 26 may be fabricated in a variety of ways. The pads 20 and 26 may be cut, sliced, die-cut or punched out of the bonded sheets or layers 21 through 23 using ordinary processing equipment. The layers 21 and 23 may be laminated, heat-sealed or welded together before forming pads 20 by heating to a suitable temperature, such as about 250°F. The sheets or layers themselves may be vacuum or compression molded of various thicknesses using common manufacturing techniques.

Although any suitable adhesive may be used when laminating the various layers together, we have found that the contact cement sold under the trademark PERMAGRIP by LePage's Inc. of Pittsburgh, Pennsylvania, is preferred.

The foregoing discussion is applicable to both types of pads 20 and 26. That is, certain key cups have grommets or the like for removably securing pads having apertures thereto. Other key cups do not require such apertures in the pads and the pads are merely glued directly to the key cups. This embodiment is shown in FIG. 3 wherein pad 20 does not have any aperture therethrough.

The aforementioned method of making pads 20 and 26 results in a pad comprised of inert materials that will not deteriorate due to moisture or the like. The seal obtained between layers 21 and 22 is such that no long clamping process is necessary to form a set. That is, the layers are immediately bonded together making manufacturing thereof a quick, easily and simple process.

The resulting pads may then be secured to key cups 17 in any suitable manner, as by glueing or clamping as discussed heretofore. The pad 20 is shown in FIG. 2 as glued to cup 17 by a suitable adhesive 27. A portion of the relatively soft layer 21 enters hole 13 and seals it off from air passing through clarinet 10. The combined resiliency of layers 21, 22 provides an effective clamping action on hole 13. Layers 22 and 23 are sufficiently rigid to provide good contact with the key cups 17. The downwardly extending peripheral wall 25 of cup 17 also serves to retain the pad 20 (or 26) thereon.

Thus, a portion of the relatively soft material of layer 21 seats within hole 13 and seals it in an airtight manner. This layer 21 is slightly greater in diameter than hole 13 and cup 17, due to its spring bias, marks where it rests in the hole 13 and thus pushes on layer 21. If the relatively soft material of layer 21 is not used, the fit of layer 21 must be so precise in order to prevent leakage that manufacturing thereof would be expensive and difficult. If the relatively harder material of layer 22 is not used, the pad might be too rigid resulting in banging when the instrument 10 is played, such noise obviously being undesirable.

It can be seen that we have disclosed sealing means for closing off the flute holes of a wind instrument in a manner whereby moisture from blowing through the instrument cannot cause leaks and break the seal. The pads 20 and 26 comprising the sealing means have a long life, are trouble free and need not be replaced as often as prior art pads.

We claim:

1. In sealing means for a wind instrument having a plurality of spaced holes normaly closed by key cups having pads thereon sealing off the holes with respect to the atmosphere, the improvement which comprises:

said pads being comprised of a first layer of a relatively soft, closed-cell, cross-linked polyethylene foam material bonded to a second layer of a closed-cell polyethylene foam material of a rigidity greater than said first layer, a portion of said first layer entering one of said holes when said one of said holes is normally closed by one of said key cups.

2. In the sealing means of claim 1 wherein the density of said first layer is about four pounds per cubic feet and the density of said second layer is between about 30 to 40 pounds per cubic feet.

3. In the sealing means of claim 2 wherein said first layer is about 40 mils in thickness and said second layer is about 80 mils in thickness.

4. In the sealing means of claim 3 wherein said first layer is laminated to said second layer.

5. In the sealing means of claim 4 wherein said first layer is Volara material and said second layer is Volite material.

6. In the sealing means of claim 5 wherein said first layer is Type A Volara material.

7. In the sealing means of claim 6 wherein a third layer of material having indicia thereon is adhered to said second layer, said third layer being fixedly secured to said key cup.

8. In the sealing means of claim 6 wherein said first layer is slightly greater in overall diameter than said tone hole.

9. A pad for sealing off the tone hole of a wind instrument or the like comprising:

a first layer of a relatively soft, closed-cell, cross-linked polyethylene foam material bonded to a second layer of a closed-cell polyethylene foam material of a rigidity greater than said first layer.

10. The pad of claim 9 wherein the material comprising said first layer has a density of about 4 pounds per cubic foot and the material comprising said second layer has a density of between about 30 and 40 pounds per cubic foot.

11. The pad of claim 10 wherein said first layer is about 40 mils in thickness and said second layer is about 80 mils in thickness.

12. The pad of claim 11 wherein said first layer is laminated to said second layer.

13. The pad of claim 12 wherein said first layer is Volara material and the second layer is Volite material.

14. The pad of claim 13 wherein said first layer is Type A Volara material.

15. The pad of claim 14 wherein a third layer of material having indicia thereon is adhered to said second layer.

* * * * *